US006357187B1

(12) United States Patent
Haldeman

(10) Patent No.: US 6,357,187 B1
(45) Date of Patent: Mar. 19, 2002

(54) DOOR FRAME PROTECTOR

(76) Inventor: Matthew K. Haldeman, 36803 SE. 25th St., Washougal, WA (US) 98671

( * ) Notice: Subject to any disclaimer, the term of this patent is extended or adjusted under 35 U.S.C. 154(b) by 0 days.

(21) Appl. No.: 09/406,079

(22) Filed: Sep. 27, 1999

Related U.S. Application Data

(60) Provisional application No. 60/102,169, filed on Sep. 28, 1998.

(51) Int. Cl.[7] ..... E06B 1/04

(52) U.S. Cl. ..... 52/211; 52/716.8; 52/717.01; 52/717.03; 52/717.05; 52/717.06; 49/462

(58) Field of Search ..... 52/717.01, 716.8, 52/717.03, 717.05, 717.06, 211; 49/462

(56) References Cited

U.S. PATENT DOCUMENTS

| | | | |
|---|---|---|---|
| 1,620,933 | A | 3/1927 | Wilcox |
| 2,837,787 | A | 6/1958 | Wright |
| 3,271,919 | A | 9/1966 | Olton |
| 3,391,509 | A | 7/1968 | Fruman |
| 3,451,169 | A | 6/1969 | Arnold et al. |
| 4,443,508 | A | 4/1984 | Mehl |
| 4,768,320 | A | 9/1988 | Weller |
| 5,488,804 | A | 2/1996 | Batscher |
| 5,737,878 | A | 4/1998 | Raulerson et al. |

*Primary Examiner*—Carl D. Friedman
*Assistant Examiner*—Yvonne M. Horton
(74) *Attorney, Agent, or Firm*—Kolisch, Hartwell, Dickinson, McCormack & Heuser, PC

(57) ABSTRACT

A device for protecting the edge of a doorway. The device includes opposing contact edges which extend around the edge of a doorway to contact and grip opposing walls adjacent the doorway. The edge of the doorway, which may include a door frame, is enclosed within a protective space defined by the device. Alternatively, the device may be mounted on a doorway and an attached door so that both the edge of the doorway and a portion of the door are enclosed within a protective space defined by the device. The device may be modified in the field to fit doorways and/or doors of various sizes.

19 Claims, 2 Drawing Sheets

DOOR FRAME PROTECTOR

CROSS-REFERENCE TO RELATED APPLICATIONS

This application claims priority from U.S. Provisional Patent Application Serial No. 60/102,169 entitled DOOR FRAME PROTECTOR filed on Sep. 28, 1998, the disclosure of which is herein incorporated by reference.

FIELD OF THE INVENTION

The invention relates generally to doorways, and more particularly to a device that protects doorways from being damaged, such as during construction and moving.

BACKGROUND OF THE INVENTION

The invention is a protector for door frames and is particularly useful during construction or moving activities. During construction of a building or home, a contractor is often required to repair door frames which have been damaged during the construction as workers bring equipment and material through the doorway. Door frames are often the most narrow passage in a building or home and any inattention or mistake by the workers can cause the equipment or materials to strike the frame's jambs or header and cause damage. A similar problem is often present during a move-in or move-out when furniture or other large, heavy objects are moved through a doorway. Similarly, carpet cleaners often need to drag hoses through the house, and these hoses may scratch or otherwise damage the lower portion of the frame. One solution that moving companies have devised is to wrap moving blankets around the door frame and hold them in place with large clamps. However, this approach is awkward, time- and labor-intensive to install, and the clamps may cause damage to the furniture or other objects being moved though the doorway. Furthermore, the direct contact between the blanket and the door frame provides some protection against glancing blows, but provides much less protection against forceful contact which could dent or scratch the frame regardless of the blanket's presence.

SUMMARY OF THE INVENTION

The invention is a protector for door frames and is particularly useful during construction or moving activities. The invented door frame protector comprises a sturdy, yet flexible structure that can provide protection by surrounding a door frame, and that has sufficient rigidity to protect the enclosed door frame from being struck by objects passing through the doorway. Although various shapes and configurations are possible, one configuration that is particularly effective is a slotted cylinder of durable cardboard that has a long slot removed along the entire length of the cylinder. The door frame protector may also be made of plastic or any other suitable material and may include padding at the edges of the slot to prevent scraping the door frame or adjacent wall portions. Furthermore, the door frame protector may be constructed in various sizes to adapt to virtually any size of doorway. Finally, the protector may be easily modified in the field to fit various sized installations by simply cutting the protector to the desired length and/or cutting the slot wider.

In operation, the user flexes the door frame protector apart from its resting, unbiased position to a flexed position to allow the doorjamb or other edge portion of the door frame to pass within the slot. Once the edges of the protector pass around the portion to be enclosed, they spring back to a medium position where they rest against and grip the adjacent wall portions. Preferably, the door frame protector is positioned to create an airspace between the protector and the door frame to further aid in protecting the door frame from damage when objects strike the protector. For maximum protection, a door frame protector may be placed on both jambs and the header of the door frame. Finally, the door frame protector may also be used on a door frame after the door has been hung, provided the door is capable of being opened substantially more than 90° from its closed position. To protect both the door and the portion of the jamb which is connected to the door, the user simply opens the door as far as possible and then flexes the protector to fit around both the doorjamb and the door. Alternatively, the user may first cut the slot wider and then flex the protector to fit around the door and doorjamb combination.

DETAILED DESCRIPTION OF THE PREFERRED EMBODIMENTS AND BEST MODE OF THE INVENTION

Figure 1:
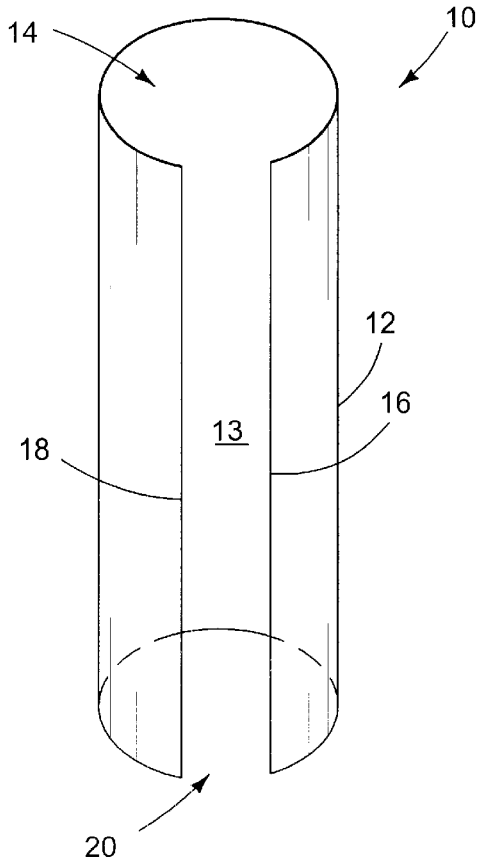
FIG. 1 is a front elevation view of a door frame protector constructed according to the present invention.

A door frame protector according to the present invention is shown generally at 10 in FIG. 1. Door frame protector 10 includes a substantially rigid outer surface 12 and an inner surface 13 between opposing contact edges 16 and 18. Door frame protector 10 is shaped such that edges 16 and 18 face in opposite directions and create an enclosed, protective space 14 within inner surface 13. Typically, though not necessarily, door frame protector 10 is shaped such as to leave a gap or slot 20 between edges 16 and 18. In FIG. 1, protector 10 is shown in what typically will be a truncated length. It should be understood that protector 10 may be sized to correspond with conventional sizes of door frames, jambs and headers, or may be formed in predetermined lengths, such as lengths between 2.5 and 7 feet.

Although many shapes are possible, in the preferred embodiment, door frame protector 10 is shaped as an elongate, slotted cylinder having a substantially circular or C-shaped cross-section as viewed along its elongate axis. The interior of the cylinder is hollow, thus forming protective space 14. Opposing edges 16 and 18 are spaced apart to form slot 20. The width of slot 20 is less than the diameter of the door frame protector.

While outer surface 12 is substantially rigid, door frame protector 10 remains sufficiently flexible to allow edges 16 and 18 to be moved apart, thereby increasing the width of gap 20 from an initial relaxed width to a substantially larger flexed width. Additionally, when edges 16 and 18 are moved apart, the diameter of the door frame protector also increases from an initial relaxed diameter to a substantially larger flexed diameter. This combination of flexibility and rigidity is achieved by proper selection of the material of construction of the door frame protector.

Protector 10 should be formed of a material that is flexible, or resilient enough to flex from an initial, resting position to a flexed position in which the protector extends around a jamb or header portion of a door frame or the combination of a doorjamb and an attached door. Furthermore, the material should be sufficiently durable to withstand the force of being impacted by objects and people traveling through the doorway. Preferably, the material not only withstands the force, but also maintains a buffer between its inner surface and the enclosed door frame and abutting wall portion. Though many materials are suitable, cardboard has proven to be an effective, inexpensive material. Plastic or other materials meeting the requirements discussed herein may also be used. In addition to being rigid and flexible, both cardboard and plastic have the added advantages of being lightweight and inexpensive.

An example of a suitable material of construction is spiral-wound cardboard having a thickness of between approximately ⅛ inch and approximately ½ inch, and preferably approximately ⅜ inch. This material has been found to be sufficiently rigid so as to provide excellent protection to a door jamb structure while remaining sufficiently flexible to be capable of installation on a wide range of differently sized door jamb structures. Furthermore, the cardboard may easily be cut to the desired size at the installation site, such as with a utility knife.

Figure 2:
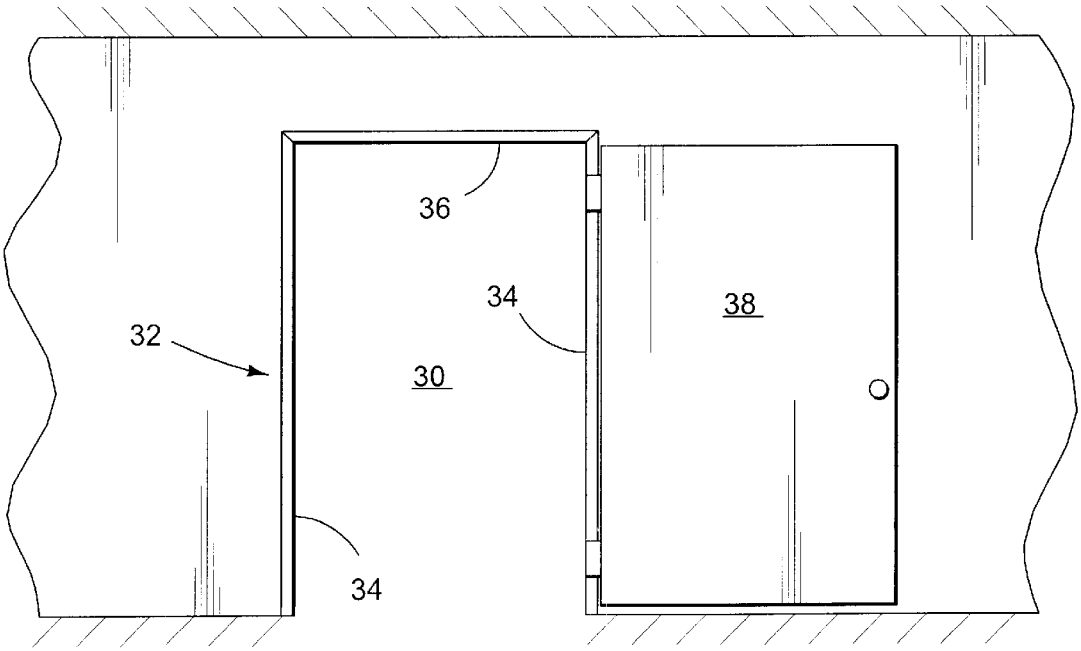
FIG. 2 is a front elevation view of a conventional doorway and door frame.

A typical doorway is shown generally at 30 in FIG. 2. Doorway 30 is well known in the construction art and includes a door frame 32 having a pair of laterally spaced jambs 34 and a header 36 connecting the upper portions of each jamb 34. The jambs and header typically have a similar or identical cross-sectional configuration. Frame 32 may vary in dimensions, depending upon the depth or thickness of the wall and size of the cavity or doorway. Examples of standardized widths for the framing members are 4⅛ inches for a stucco or similar house, 4⁹⁄₁₆ inches for a two-by-four framed house, and 6⁹⁄₁₆ inches for a two-by-six framed house. Similarly, jambs 34 are typically approximately seven feet long (usually eighty-one and one half inches), and header 36 is typically thirty, thirty-two or thirty-six inches long.

Typically, one of the jambs has a door 38 mounted upon it with hinges, while the other has a strike plate 40 that is positioned to receive a latch or other clasp on the door to retain the door in a closed position. Sometimes, however, there is no door mounted on a jamb. Other times, the door is a pocket door that slides out through one of the jambs from within the wall, or the door swings freely without engaging the other jamb. Other variations exist, as are known in the art.

Figure 3:
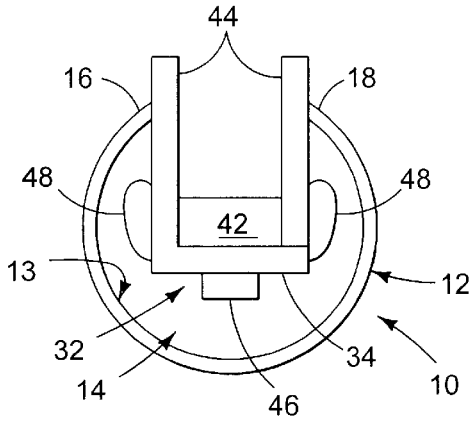
FIG. 3 is a cross-sectional view showing the invented protector mounted on a jamb of a door frame of FIG. 2.

The size of doorway 30 is largely defined by the supporting studs and adjacent wall board portions of the wall in which the doorway is formed. Typically the portion of the wall framing doorway 310 includes at least one stud 42 spaced between two wall boards 44 which are nailed or screwed into opposite sides of stud 42, such as shown in FIG. 3. Stud 42 is typically a standard 2×4 or 2×6 inch board, and wall boards 44 are typically composed of sheet rock having a thickness in the range of approximately ¼ inch to approximately ¾ inch. The construction of door frame 32 and the adjacent wall portions defining doorway 30 may vary as is known in the art, and the invented door frame protector is able to be used with all of these constructions.

In FIG. 3, a cross-sectional view of one of jambs 34 or header 36 is shown as an illustrative example of the cross-sectional configuration of a conventional door frame 32. Frame 32 is sized to extend from the outer surface of one wall board to the outer surface of the other wall board. A stop 46, preferably constructed of wood or metal, is usually nailed or screwed into jamb 34 opposite stud 42. Stop 46 is usually sized so as not to extend the width of jamb 34 or header 36. Brickmold or other trim pieces 48 are typically formed as decorative strips of wood or metal and are secured to door frame 32 and/or stud 42. The trim pieces 48 are preferably positioned to cover the interface between door frame 32 and wall boards 44.

While door frame 32 described above is an illustrative example of a conventional door frame, there are many variations well known in the construction art. For example, trim pieces 48 may be eliminated or additional trim pieces added. Furthermore, stop 46 may be eliminated if there is no door or if it is desired that the door be able to swing freely past the door jamb structure, such as in a hall or arch way. Alternatively, the door jamb structure may include a central opening to allow a "pocket door" to be installed between the wall boards. Additional variations, too numerous to describe, are also possible. Regardless of the type and size of door frame 32 and doorway 30 defined thereby, the invented protector 10 is able to protect the door frame from damage caused by contact as people and objects are moved through the doorway.

Figure 4:
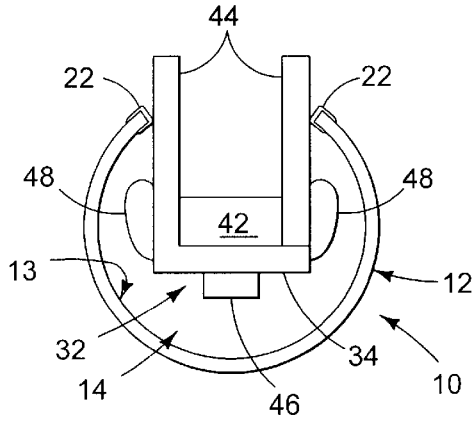
FIG. 4 is the cross-sectional view of FIG. 3 showing another embodiment of the invented door frame protector.

In FIG. 3, door frame protector 10 is shown installed on the portion of door frame 32. As shown, contact edges 16 and 18 are positioned to contact the exterior surfaces of opposing wall boards 44 such that at least a portion of the door frame passes through slot 20 and is enclosed within space 14. Preferably, edges 16 and 18 are formed to be smooth to prevent damaging the wall boards. In another embodiment depicted in FIG. 4, edges 16 and 18 include protective caps 22 to protect the wall boards from scratches or marring. Protective caps 22 may be constructed of any suitable material capable of protecting the wall boards such as paper, plastic, rubber, cloth, etc.

Figure 5:
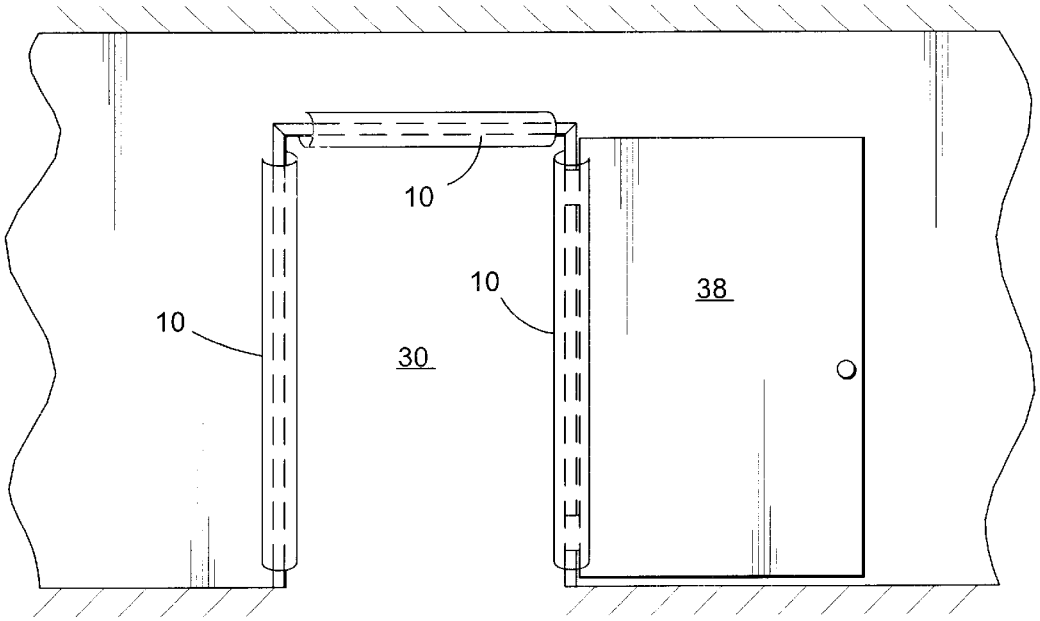
FIG. 5 is an environmental view showing the protector of FIG. 1 mounted on the jambs and the header of the door frame of FIG. 2.

When installed, the door frame protector acts to protect the door frame by enclosing the door frame within space 14. Rigid outer surface 12 absorbs or deflects objects passing through the doorway which might otherwise strike the door frame. For maximum protection, a door frame protector may be installed on each vertical edge as well as the upper, horizontal edge of a doorway, as shown in FIG. 5.

In a preferred embodiment, the door frame protector is sized such that, when installed on a door frame, the inner surface 13 does not contact the door frame. Instead, the only contact is between edges 16 and 18 and the wall boards 44. Thus, a buffer space is established between the inner surface and the trim pieces, jamb, and stop. This buffer space further protects the door jamb structure from damage because it enables the protector to deform or flex under a force of contact without allowing the force to be transmitted to the door frame.

In another embodiment, cushioning material may be placed adjacent at least some portion of the inner surface to further protect the door jamb structure. This cushioning material may be attached to the inner surface such as by gluing, or may be placed in a frictional fit between the inner surface and the door jamb structure. If the cushioning material is attached to the inner surface, a buffer space may be established between the cushioning material and the door jamb structure. Alternatively, the cushioning material may extend from the inner surface to contact the door jamb structure.

Protector 10 may be used on all portions of a door frame, even the jamb to which a door is attached, provided the door can be opened beyond 90° from its closed position. As shown in FIG. 5, the invented door frame protector may be flexed to fit around the combination of door frame 32 and door 38. In the preferred embodiment, the door frame protector may be resized, if necessary, at the installation site to fit around both the door frame and the door. This may be done by the user enlarging slot 20 by cutting away a strip of the protector. Especially when the protector is constructed from cardboard or a similar material, this can be done on-site with a utility knife or other cutting implement. Because the protector is sufficiently flexible to widen to a larger diameter than its resting diameter, often times the size of the slot will not need to be enlarged for the protector to fit around the jamb and a portion of the door. In any event, the door jamb protector thus acts to protect the portion of the door which is adjacent the doorway as well as the door frame.

Door frame protector 10 may be manufactured having various lengths as well as various relaxed diameters and slot widths to fit various sized door frames. Additionally, protector 10 is preferably constructed of a material that may be re-sized by the person installing the door jamb protector. This re-sizing may be accomplished in a variety of ways including cutting, tearing or folding.

Thus, for example, the installer might shorten the protector by cutting perpendicular to the elongate axis. Additionally, the installer might widen slot 20 by cutting parallel to the elongate axis and adjacent edge 16 and/or 18. The ability to re-size the protector at the installation site allows a single protector to be installed on a plurality of door frames of varying sizes as well as on jambs to which doors are attached.

Door frame protector 10 is preferably sized to have a resting, or relaxed, diameter approximately equal to or larger than the width of the door frame or combination of the door frame and door. For most conventional door frames, resting diameters of between approximately 5 inches and approximately 10 inches may be used, with diameters of approximately 6 inches and approximately 8 inches proving to be very effective. It should be understood that diameters outside of this range are also within the scope of the present invention.

The door jamb protector may be re-sized, if necessary, at the installation site to the desired length and slot width. Preferably, the slot width is sized to be narrower than the width of the door frame or combination of door jamb structure and door. This allows edges 16 and 18 to press against and grip the wall boards 44. This gripping force, caused by edges 16 and 18 pressing against the wall and/or door adjacent the jamb as the protector tries to return to its resting configuration, is sufficient to maintain the protector in a selected position on the door frame, regardless if the protector is in contact with the floor, sill of the frame or other base surface.

To install the door frame protector, the installer flexes the protector to widen the slot from an initial relaxed width to a substantially larger flexed width. The installer then passes the edges around the portion of the door frame to be protected and allows the protector to relax toward its initial relaxed position. If the relaxed slot width is sized to be less than the width of the door frame, edges 16 and 18 will contact and press against wall boards 44 before slot 20 returns to its relaxed width. Thus, the edges will grip the wall boards and act to hold the door frame protector in place.

Alternatively, if the door frame includes an attached door, the installer flexes the protector to fit around the combination of the door jamb and the door mounted on that jamb. If the relaxed slot width is sized to be less than the combination of the door jamb and the door, one edge will contact a wall board and the other edge will contact the door. Thus, the edges will grip the wall board and door and act to hold the protector in place

I claim:

1. A door frame protector for temporary use on a doorway through a wall having opposing wall surfaces, comprising:

opposing contact edges adapted to contact and grip the opposing wall surfaces adjacent a doorway;

an impact-deflecting outer surface extending between the contact edges; and an inner surface opposite the outer surface, the inner surface defining a continuous protective space along its length and between its contact edges and being sized to enclose, without contacting, an edge of the doorway when the contact edges are placed in contact with the opposing wall surfaces adjacent the doorway, wherein the protector is adapted to be cut anywhere along its length or cross-section with a knife to selectively resize the protector.

2. The door frame protector of claim 1, wherein at least one of the contact edges includes a protective cap to protect the wall surfaces, wherein the cap extends across the contact edge to prevent contact between the edge and the wall surface, and further wherein the cap is formed from a material adapted to prevent scratches to the wall surface.

3. The door frame protector of claim 1, further comprising cushioning material underlying at least a portion of the impact-deflecting outer surface.

4. The door frame protector of claim 1, wherein the outer surface is substantially rigid.

5. The door frame protector of claim 1, wherein the opposing contact edges are separated by a gap, and wherein the inner and outer surfaces are at least partially flexible so that the gap may be increased from an initial width to a larger flexed width.

6. The door frame protector of claim 1, wherein the inner surface is adapted to define a protective space sized to enclose, without contacting, a door frame mounted on the edge of the doorway so that the edge of the door frame is received into the slot and enclosed by the cylinder.

7. The door frame protector of claim 1, wherein the protector is at least substantially formed from cardboard.

8. The door frame protector of claim 2, wherein the material is selected from the group consisting of paper, plastic, cloth, and rubber.

9. The door frame protector of claim 3, wherein the cushioning material is at least substantially coextensive with the impact-deflecting outer surface.

10. The door frame protector of claim 6, wherein the protector is further adapted for use with a door frame having a door pivotally mounted thereon, and further wherein the protector is adapted to receive the door frame and a portion of the door within the protective space.

11. A method for protecting the edge of a doorway, comprising:

providing a substantially rigid, elongate cylinder having a slot extending along the length thereof, wherein the cylinder is adapted to be cut with a knife along at least one of its length or cross-section to resize the cylinder;

aligning the slot with the edge of the doorway; and mounting the cylinder on the doorway so that the edge of the doorway extends into the slot and is enclosed by the cylinder.

12. The method of claim 11 further comprising measuring the edge of the doorway and modifying the cylinder to fit the edge of the doorway by cutting the cylinder along at least one of its length or cross-section to enlarge the slot or shorten the length of the cylinder.

13. The method of claim 11, wherein the step of mounting includes flexibly expanding the cylinder so that the slot extends around the edge of the doorway.

14. The method of claim 11, wherein the doorway includes a door attached to the edge of the doorway, and wherein the step of mounting includes mounting the cylinder on the doorway so that the edge of the doorway and a portion of the door extend into the slot and are enclosed by the cylinder.

15. The method of claim 14, wherein the step of mounting includes flexibly expanding the cylinder so that the slot extends around the edge of the doorway and the door.

16. The method of claim 11, wherein the cylinder is formed at least substantially from cardboard.

17. The method of claim 11, wherein the cylinder has a generally uniform cross-sectional configuration along its length to provide protection to the doorway along the entire length of the cylinder.

18. A door frame protector for temporary use on a doorway through a wall having opposing wall surfaces, comprising:

opposing contact edges adapted to contact and grip the opposing wall surfaces adjacent a doorway;

an impact-deflecting outer surface extending between the contact edges; and an inner surface opposite the outer surface, the inner surface defining a protective space along its length that is sized to enclose an edge of the doorway when the contact edges are placed in contact with the opposing wall surfaces adjacent the doorway, wherein the protector is adapted to be cut along its length or along its cross-section to resize the gap or the length of the protector.

19. The door frame protector of claim 18, wherein the outer surface is formed at least substantially of cardboard.

* * * * *